US006164637A

United States Patent [19]

Harari

[11] Patent Number: 6,164,637

[45] Date of Patent: Dec. 26, 2000

[54] FOIL REMOVER WITH IMPROVED GRIPPER

[75] Inventor: Shahar Harari, Tel Aviv, Israel

[73] Assignee: Scitex Corporation Ltd., Herzlia, Israel

[21] Appl. No.: 09/138,398

[22] Filed: Aug. 24, 1998

[30] Foreign Application Priority Data

Sep. 3, 1997 [IL] Israel ..... 121699

[51] Int. Cl.[7] ..... B65H 3/30

[52] U.S. Cl. ..... 271/19

[58] Field of Search ..... 271/19; 101/408

[56] References Cited

U.S. PATENT DOCUMENTS

| | | | |
|---|---|---|---|
| 1,225,740 | 5/1917 | Anderson . | |
| 3,940,125 | 2/1976 | Morton . | |
| 4,019,729 | 4/1977 | Morton . | |
| 4,157,823 | 6/1979 | Morton . | |
| 4,157,824 | 6/1979 | Littlewood | 271/10 X |
| 4,178,097 | 12/1979 | Sara . | |
| 4,375,285 | 3/1983 | Dennhardt . | |
| 4,583,727 | 4/1986 | Fort | 271/19 |
| 4,641,827 | 2/1987 | Walton et al. . | |
| 4,676,396 | 6/1987 | Mamolou . | |
| 4,871,206 | 10/1989 | Gazzarrini . | |
| 5,018,715 | 5/1991 | Reeves et al. | 271/19 |

FOREIGN PATENT DOCUMENTS

| | | | |
|---|---|---|---|
| 0 128 480 | 12/1984 | European Pat. Off. . | |
| 21 08 401 | 9/1972 | Germany . | |
| 107 649 | 8/1974 | Germany . | |
| 001650542 | 5/1991 | U.S.S.R. | 271/19 |

*Primary Examiner*—Christopher P. Ellis
*Assistant Examiner*—Kenneth W Bower
*Attorney, Agent, or Firm*—Mark M. Friedman

[57] ABSTRACT

A foil remover for removing one or more sheets of foil from an underlying hard surface. The foil remover includes a movable carrier and at least one gripper attached to the carrier. The gripper includes many pinching fingers, each of the fingers oriented approximately perpendicular to the hard surface and ending with a tip. The foil remover operates with respect to each of the grippers to bring the tips, mutually apart, in contact with the top sheet of foil and causes the tips to approach each other, and to pinch the sheets.

25 Claims, 7 Drawing Sheets

FOIL REMOVER WITH IMPROVED GRIPPER

FIELD AND BACKGROUND OF THE INVENTION

The present invention relates to a plate feeder for a lithographic platesetter and, more particularly, to a device for removing protective foils from a stack of plates.

A lithographic platesetter (or platesetter, for short) serves to record images on lithographic plates (which usually serve for offset lithographic printing) according to digitally supplied data. In operation of a platesetter, a fresh plate is loaded onto a recording surface (usually a drum), exposed to a modulated beam of energy, then unloaded. For automatic operation, a platesetter may be equipped with a plate feeder, which serves to pick one plate, at a time, from a stack of fresh plates and to transfer it to a loading mechanism; the latter loads the plate onto the recording surface. In some platesetters, the plate feeder and the loading mechanism may be an integrated system. The pack lies in a generally horizontal or inclined orientation and each time, the top plate is picked up for feeding. For convenience, the stack of plates is simply the contents of a pack of plates, as packaged and shipped by their manufacturer. Such packaging includes interleaving sheets of paper, or of similar foil material, with the plates; that is, between any two adjacent plates there is a sheet of paper. The purpose of the foil is to protect the sensitive face of the plate from damages, such as scratches, that may be caused by rubbing against the back face of the adjacent sheet.

Obviously, the paper must not be loaded onto the platesetter and therefore it must be removed from the top plate prior to the plate being picked up for feeding. Now, picking of the plate is usually carried out by means of vacuum suction cups, which are attached to a movable beam. According to prior art, these suction cups sometimes also serve to remove the protective paper sheets and to carry them to a discarding station. Such a method has several disadvantages:

(i) Often, the paper is porous; the vacuum then reaches the underlying plate and may cause it to be picked with the paper, unless the vacuum level is carefully controlled; this encumbers the vacuum system.

(ii) For porous paper, the vacuum system must have a high rate of air flow—which increases its cost; it is noted that recycled and recyclable paper, which is used ever more frequently for the purpose, is usually porous, since coating it makes its recycling environmentally unsafe.

(iii) Sometimes more than one sheet are found between any pair of plates; if the sheets are not sufficiently porous, the vacuum cups pick only one sheet at a time; this prolongs the process and makes automatic operation rather difficult, since it is then required to sense the presence of additional sheets.

In some plate feeders of prior art, there is a dedicated vacuum suction system for removing the paper. This overcomes the first of the enumerated disadvantages, but leaves the other two; moreover such a foil removal device is relatively complex and thus—expensive. In yet other feeders of prior art a system of rotating brushes is employed to remove the protective foils and transfer them to a discarding station. Such a system is bulky and, therefore, disadvantageous.

A similar plate feeder may also be utilized in other machines, for example—in an offset printing press that is equipped to record an inking image onto a plate directly on the press and which is further equipped with an automatic plate loading system. The present invention may be applicable to such feeders as well.

There is thus a widely recognized need for, and it would be highly advantageous to have, an economical, compact and effective device, within a plate feeder for a platesetter, for removing protective foil from the top plate of a stack, prior to feeding it to the platesetter.

SUMMARY OF THE INVENTION

The present invention successfully addresses the shortcomings of the presently known configurations by providing, in a plate feeder, an economical foil remover that can grip practically all foils (such as paper sheets) that lie on top of a plate and move them together to a disposal station, regardless of the porosity of the foils.

The present invention discloses a novel foil gripper, which does not use vacuum, but rather uses flexible fingers that pinch the foils. It further discloses a simple means for activating such pinching action.

More specifically, the foil gripper of the present invention, according to a preferred configuration, consists of a pair of spring blades, mutually attached at one end and slightly curved outwards at the other end (where they are formed as tips), together slidable through a slot in a chuck. When the common end is near the chuck, the tips are far from each other; when the blades are slid so that the tips approach the chuck, the tips approach each other.

In a practical foil remover, several such grippers may be mounted on a moving gantry, which is operative to move gripped foils from a stack of fresh plates to a disposal station. The gantry includes a beam, to which the chucks of the grippers are attached. The beam is parallel to the edge of the stack and movable in a plane perpendicular to the faces of the plates and just inside the stack's edge.

In operation, the tips of the blades are initially apart. The beam is made to approach the stack; after the tips contact the top foil (lying over the top plate), the blades are thus forced to slide up through the chuck, thereby causing the tips to approach each other. This, in turn, causes the tips to pinch the foils and thus to grip them. Thereafter, the beam is raised and the gantry is made to move to the disposal station, dragging the foils with it, where the foils are removed from the grippers and delivered to a collection bin.

According to the present invention there is provided a foil remover, for removing one or more sheets of foil from an underlying hard surface, comprising a movable carrier and at least one gripper, attached to the carrier, the gripper including a plurality of pinching fingers, each oriented approximately perpendicularly to the hard surface and ending with a tip, the foil remover being operative, with respect to each of the grippers, to bring the tips, while mutually apart, in contact with the top sheet of foil and thereupon to cause the tips to approach each other and thereby to pinch any of the sheets.

According to further features in preferred embodiments of the invention described below, the foil remover, also comprises a chuck with at least one aperture therethrough and wherein the fingers are elastic and are slidably mounted within the aperture and curved, so that when they slide along the aperture in a first direction such that the tips become nearer the chuck, the tips approach each other, and when the fingers thus slide in an opposite direction, the tips move mutually apart. preferably, the number of fingers is two, each of the fingers is formed as a blade, the number of the apertures is one or two, and each of the apertures is formed as a slot.

According to still further features in the described preferred embodiments, each of the chucks is fixedly attached to the carrier and the carrier is movable along a path that is approximately perpendicular to the hard surface; also, the foil remover further comprises a stopper corresponding to each of the grippers, each of the stoppers being cooperative with the carrier to push the blades of each corresponding one of the grippers in the first direction, thereby causing the tips to separate.

In a wider aspect of the present invention, the hard surface is the top surface of a plate that is generally the top plate of a stack of plates and the foil is a soft separation foil generally lying between the plates, the foil remover is part of a plate feeder and the preferred embodiment of the foil remover further comprises a disposal station and is further operative to move the carrier to the disposal station, which, preferably includes a pair of pinch rollers, operative to remove any sheets carried by the carrier.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1B:
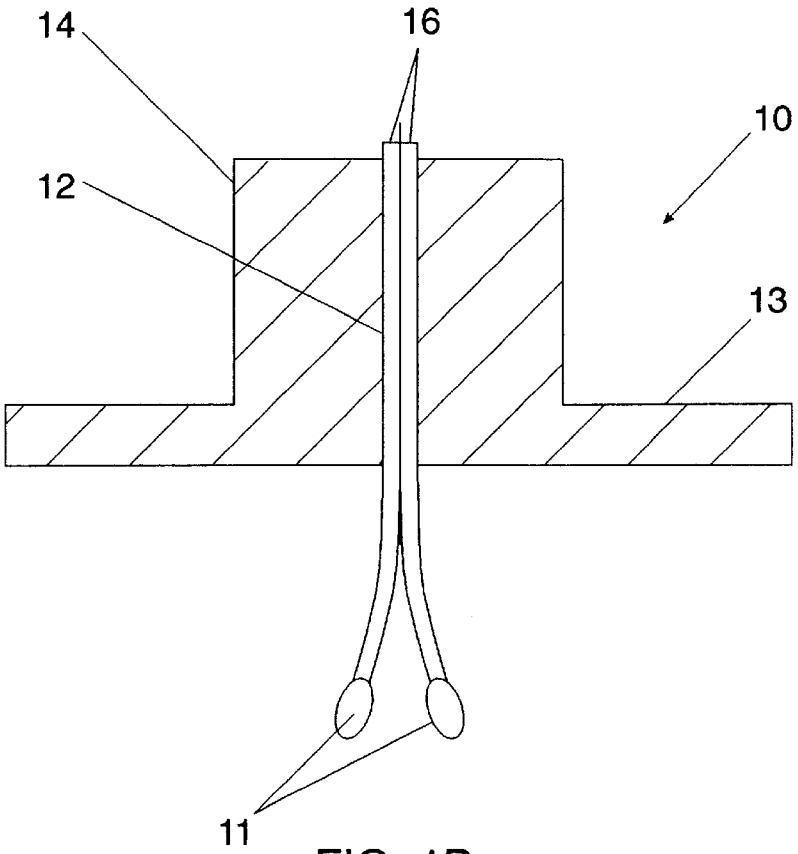
FIGS. 1A and 1B are top- and side cross-sectional views, respectively, of a gripper according to a preferred embodiment of the present invention.
Figure 1A:
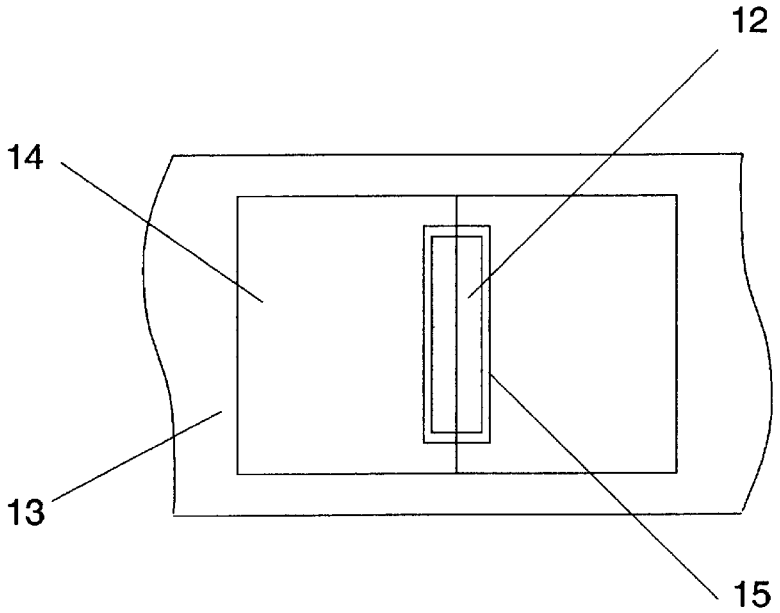

The present invention is of a foil remover, within a plate feeder, for removing protective foils from the top surface of a printing plate prior to feeding it to a platesetter. Specifically, the present invention is of a novel gripper, within a foil remover, which can be used to pick the foils and to release them at a disposal station. The principles and operation of a foil remover according to the present invention may be better understood with reference to the drawings and the accompanying description. Referring now to the drawings, FIG. 1A and 1B illustrate a gripper according to a preferred embodiment of the present invention. There is seen a beam 13, which is part of a carrier assembly (not shown), to be described herebelow. On beam 13 are mounted a plurality of gripping assemblies, to be referred to as grippers 10.

Figure 2A:
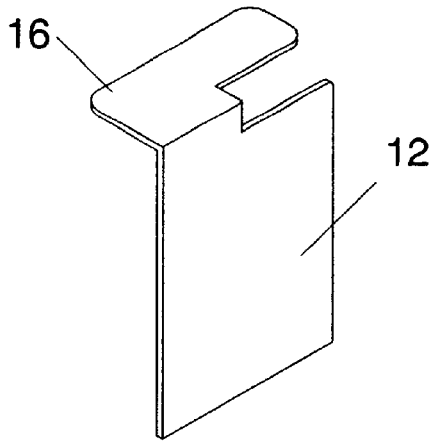
FIG. 2A is an isometric view of a pinching finger.
Figure 2B:
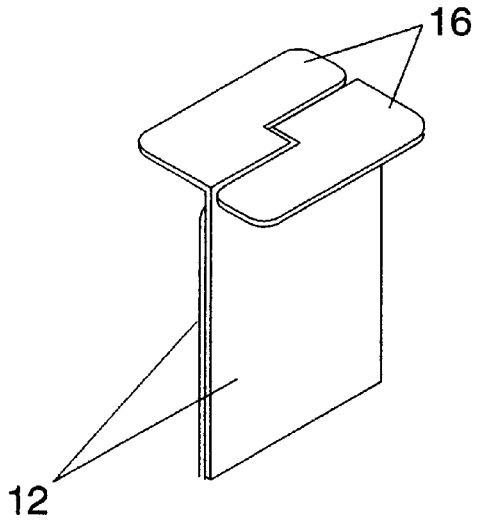
FIG. 2B is an isometric view of an assembled pair of pinching fingers, which are part of the gripper of FIG. 1A.

Each gripper 10 consists of a chuck 14, fixedly attached to beam 13, and a pair of pinching fingers 12. Each pinching finger 12 is formed as a slightly curved spring blade, made of suitable elastic material—preferably stainless spring steel, such as type 302/304. Preferably both blades in a pair are identical and are formed so as to be inter-lockable at one end 16—for example, as illustrated in FIG. 2A; they are shown interlocked in FIG. 2B. Each finger 12, or blade, has, at one end (which is opposite the interlocking end), a tip 11, which is preferably coated with a soft high-friction substance, such as Neoprene rubber.

Chuck 14 is preferably made of a durable material, such as Acetal, that has a low but finite factor of friction, and is formed to have an aperture in the form of a slot 15 cut lengthwise therethrough; its length is substantially less than that of fingers 12. Conveniently, chuck 14 may be assembled from two halves, in which slot 15 has been formed on one or both of their joint faces. Slot 15 is formed to slidingly accommodate the assembled pair of fingers 12. Gripper 10 is assembled from the pair of fingers 12, joined back to back (possibly interlocked, as in FIG. 2B) and inserted from above through slot 15 in chuck 14 so that, when they are at the farthest possible insertion depth, their tips 11 substantially protrude and are far apart, as illustrated in FIG. 1B. The flexible curvature of fingers 12 is such that they tend to push against the faces of slot 15 and thus generate a certain mutual frictional force. In an alternative configuration, there are two parallel slots and one blade-shaped finger is inserted through each slot. In another alternative configuration, there are three or more fingers, formed as curved elastic wires and the chuck has either one aperture therethrough, accommodating all fingers together, or an aperture for each finger, the apertures being parallel and closely spaced.

Figure 3A:
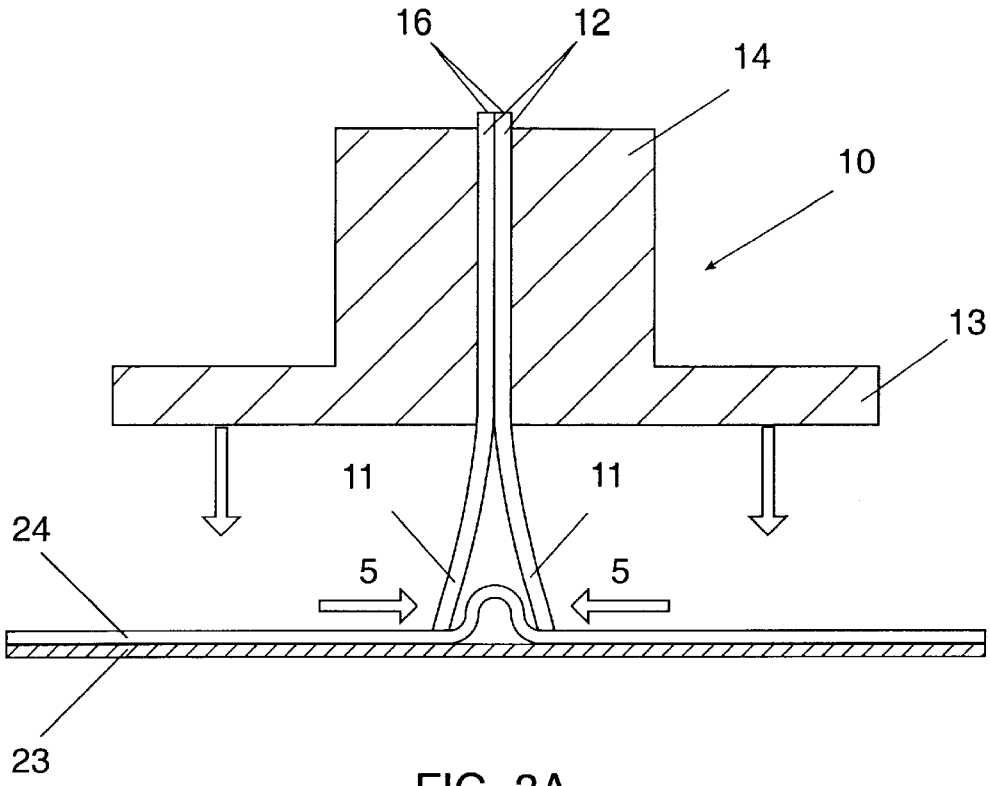
FIGS. 3A, 3B and 3C are schematic cross-sectional views of the gripper of FIG. 1A, illustrating three stages in its operation.
Figure 3B:
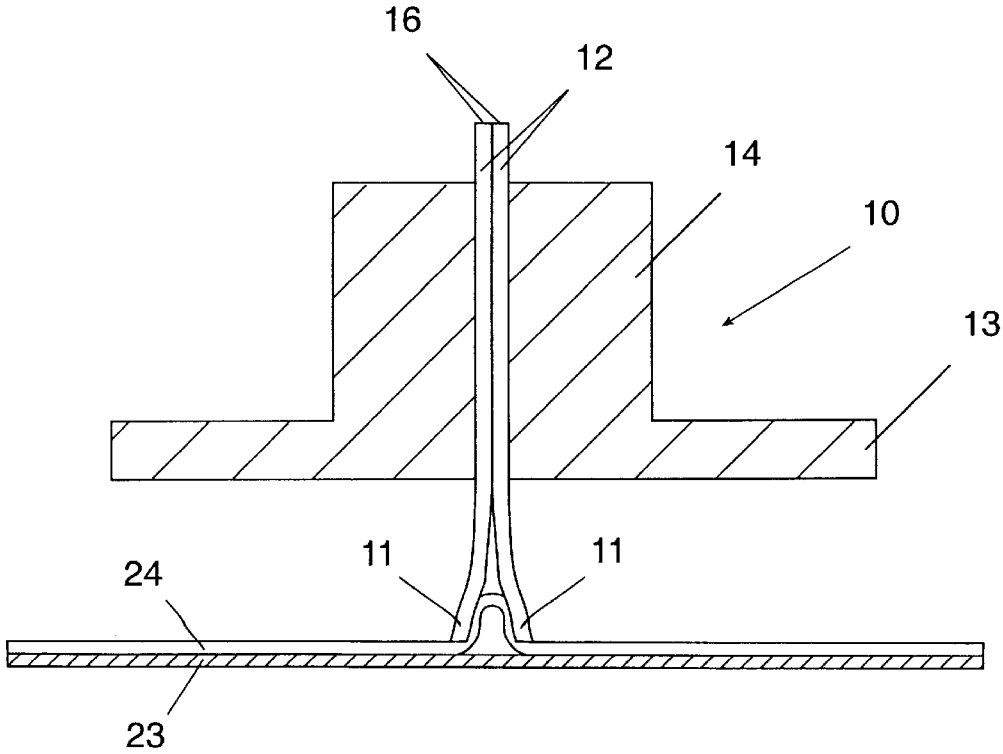
Figure 3C:
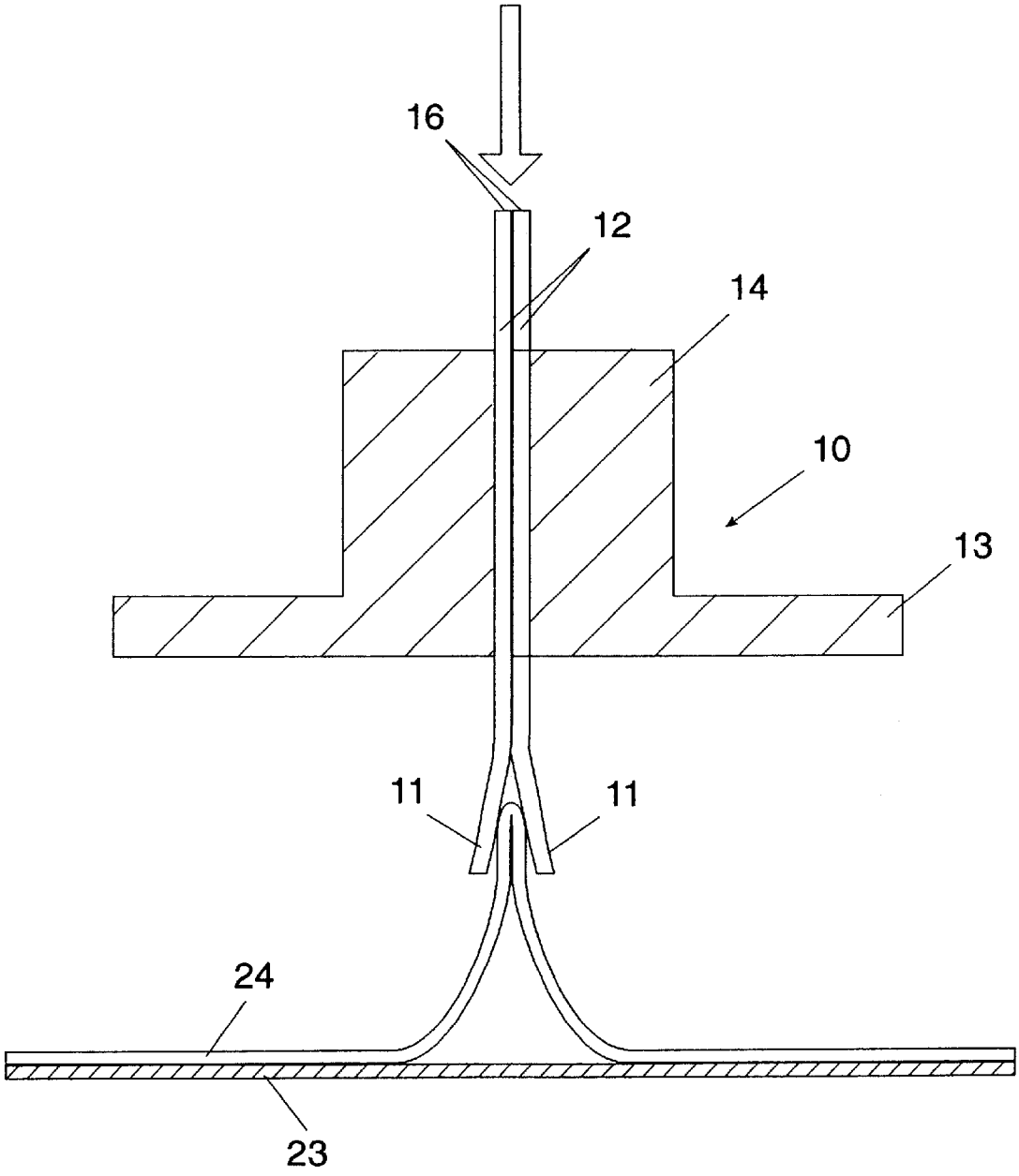

Operation of the gripper will now be explained with reference to FIGS. 3, where a foil (e.g. paper) 24 is seen to lie on top of a plate 23. It will be appreciated that, although, in the preferred embodiment, plate 23 is shown lying horizontally, the device of the present invention, as described herein, is similarly applicable for any orientation of the plate. At the beginning, fingers 12 are at their lowest position with respect to chuck 14, with tips 11 fully spread, as shown in FIG. 11B. Beam 13, with mounted gripper 10, is lowered until tips 11 touch foil 24. Beam 13, with the attached chuck 14, keeps on being lowered, but, owing to the mechanical reaction, from this point on, of plate 23 to tips 11, fingers 12 are being commensurately pushed up with respect to chuck 14. This causes the lower ends of fingers 12 and tips 11 to be gradually pushed together, as illustrated in FIG. 3A. The finite friction between fingers 12 and the faces of slot 15 causes tips 11 to exert a certain pressure on foil 24 against plate 23. Owing to this pressure and to the lateral forces 5 (FIG. 3A) by the mutually approaching ends of fingers 12, tips 11 pinch a certain portion of foil 24 (again, as illustrated in FIG. 3A). When beam 13 reaches its lowest position, fingers 12 assume a relatively high position with respect to chuck 14, leaving relatively short ends protruding below it. These cause tips 11 to exert maximal pinching force on the portion of foil pinched between them, as illustrated in FIG. 3B, thus gripping the foil. At this stage, the foil can be removed, by moving beam 13; owing to the friction between fingers 12 and the chuck 14, the relative position therebetween remains unchanged and thus the foil remains pinched and gripped. Finally (FIG. 3C), when the gripper is at a disposal station (as will be described herebelow), fingers 12 are pushed maximally down with respect to chuck 14, by means of a suitable external mechanism. This causes their ends and tips 11 to spread apart, thus releasing the foil.

It is noted that the pinching action of the finger tips on the foil, as described hereabove, is effective over a broad range of foil types and thicknesses and is independent of its structure, such as porosity or face smoothness; moreover, if several sheets of foil lie on the plate, generally all of them are pinched together. It will, thus, be appreciated that a gripper based on such pinching action, which is the primary feature of the present invention, overcomes all three disadvantages of prior art, enumerated in the background section hereabove. It will, further, be appreciated that also other configurations and embodiments of grippers based on such pinching action are possible. For example, the tips could be the ends of two members that are made to move mutually by a dedicated activator, this motion being commanded by a sensor that senses the proximity of the foil. It is noted, though, that effecting the pinching action by a mechanism of flexible fingers sliding through a chuck, owing to the reaction of the plate to the tips, as described hereabove, which is another feature of the present invention, represents a very inexpensive and reliable solution.

Figure 4:
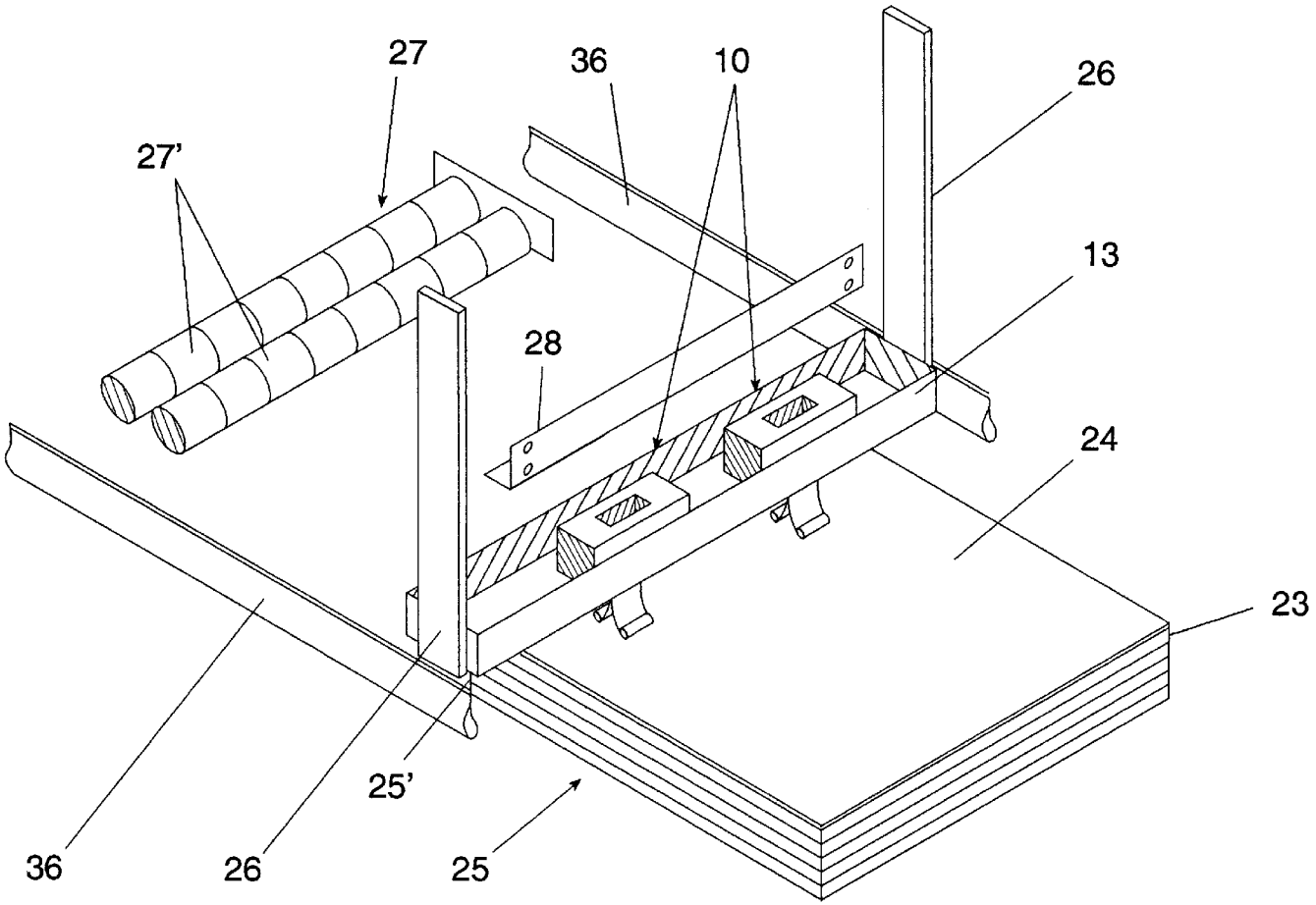
FIG. 4 is an isometric view of a foil remover incorporating the gripper of FIG. 1A.

Turning now to FIG. 4, which shows a foil remover according to the present invention, as it may be installed in the feeder portion of a platesetter, we note a stack of fresh plates 25, with a top plate 23 and, above that, a sheet of foil 24. Alongside one edge 25' of stack 25 is a gantry 26, which is movable along a path generally parallel to the face of plate 23 and perpendicular to the edge 25'—for example, on tracks 36. Toward the end of the path is a disposal station 27, consisting primarily of a pair of pinch rollers 27', oriented parallel to stack edge 25'. Mounted on vertical tracks on gantry 26 is beam 13, which is movable vertically with respect to the gantry. Motion of gantry 26 and of beam 13 on their respective tracks is effected by suitable motors or actuators (not shown). The assembly of gantry 26 and beam 13 will be referred to as a carrier. Mounted along beam 13 are a plurality of grippers 10, which are each constructed as described hereabove. Just above each gripper 10 and fixedly attached to gantry 26 is a stopper 28, formed as a horizontally oriented platelet and positioned so that top ends 16 of fingers 12 may butt against it in its upward travel. In an alternative configuration, stoppers 28 are stationarily mounted above disposal station 27, so that when the carrier is at the disposal station, they assume the same positions, relative to the corresponding grippers, as in the first configuration.

It is noted that the carrier serves to carry the grippers, which, in turn, serve to grip the foil while the carrier carries it to the disposal station. It will be appreciated that other configurations of the carrier are possible and that all of them are covered by the present invention, as long as the grippers mounted on the carrier are as described herein. Similarly, other configurations of the disposal station are possible.

Operation of the foil remover of FIG. 4 is as follows, with reference to the illustrations of FIG. 5 (where hollow arrows indicate the general direction of motion):

In the normal, or idling, state, beam 13 is at its highest position and all fingers 12 are at their lowest position with respect to their corresponding chucks 14, with tips 11 maximally spread apart. Gantry 26 is preferably at or near disposal station 27, so as to clear the space near stack 25 for plate gripping and feeding.

Figure 5A:
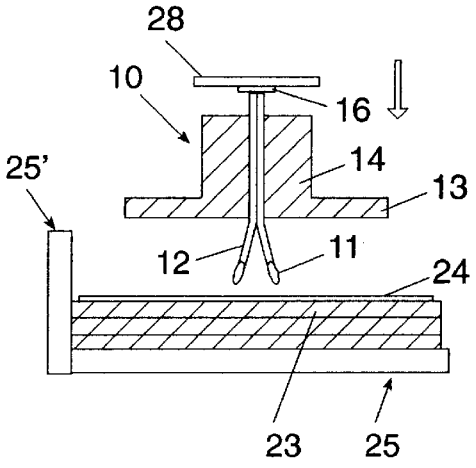
FIGS. 5A through 5E illustrate the operation of the foil remover of FIG. 4.

To begin foil removal, gantry 26 is moved to position grippers 10 over a section 29 of foil 24 that is near edge 25', as shown in FIG. 5A.

Figure 5B:
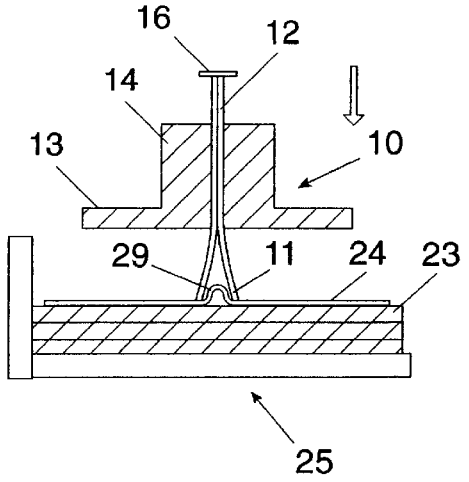

Beam 13 is then gradually lowered to its lowest position, thereby causing grippers 10 to pinch foil (or foils) 24 and thus grip section 29, as shown in FIG. 5B and as explained hereabove.

Figure 5C:
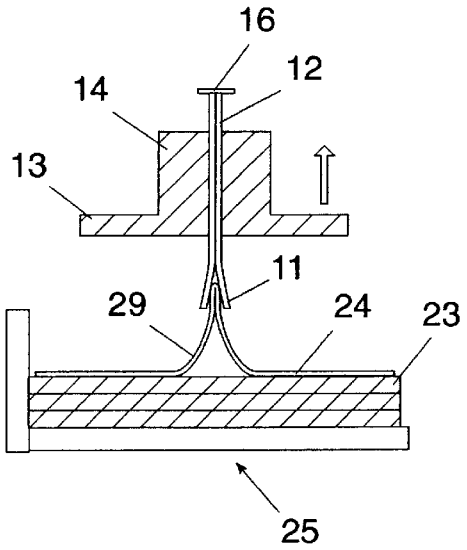

Beam 13 is then raised part of the way and not enough for ends 16 of fingers 12 to touch respective stoppers 28; the pinching effect thereby persists and foil section 29 is raised from plate 23, as shown in FIG. 5C.

Figure 5D:
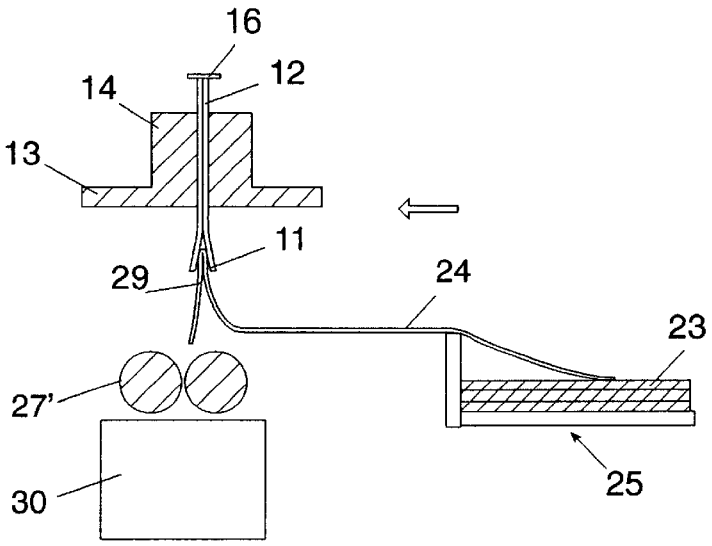

Now gantry 26 is moved toward disposal station 27, pulling the entire sheet 24 therewith, as shown in FIG. 5D.

Figure 5E:
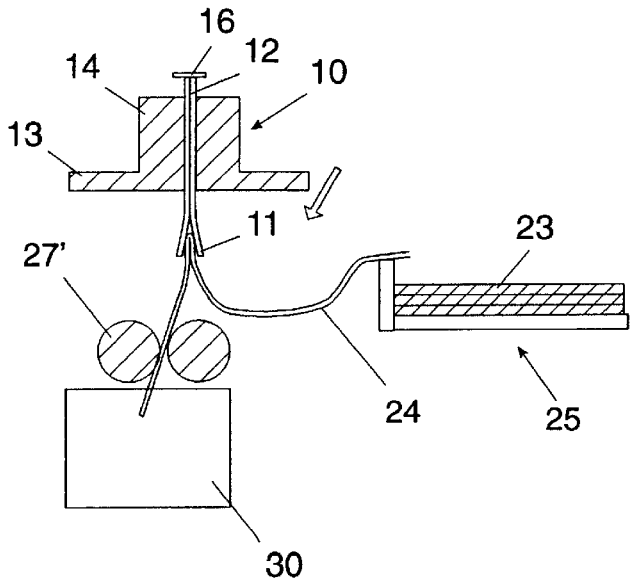

Beam 13 is then lowered part of the way until an edge of sheet 24 is caught by pinch rollers 27'; these act to pull sheet 24 out from tips 11 of gripper 10 and to deliver it to collection bin 30, as shown in FIG. 5E.

Finally, beam 13 is raised to its highest position, thereby causing upper ends 16 of fingers 12 to butt against corresponding stoppers 28 and thereby to be pushed downward within their respective chucks 14. As a result (and as explained hereabove), tips 11 are spread apart, and the entire assembly returns to its idling state.

In an alternative embodiment, the last two steps are replaced by the following: beam 13 is raised to its highest position, thereby causing upper ends 16 of fingers 12 to butt against corresponding stoppers 28 and thus—tips 11 to spread apart, thereby releasing foil section 29. The latter falls toward, and is caught by pinch rollers 27', which transport it, and the rest of sheet (or sheets) 24, to collection bin 30.

It will be appreciated that the carrier assembly, as described hereabove or in any other configuration, may share components with, or be totally integrated with, the plate picking-and moving mechanism, and yet come within the scope of the present invention; in particular, beam 13 may also have suction cups attached thereto, for picking up and feeding the plates.

More generally, while the invention has been described with respect to a limited number of embodiments, it will be appreciated that many variations, modifications and other applications of the invention may be made.

I claim:

1. A foil remover for removing at least one foil overlying an article stack, said foil remover comprising:

two flat flexible members, each of said members having a first end and a second end, said two flexible members cooperatingly configured for said respective second ends to move laterally with respect to each other;

a chuck, slidably receiving said two flexible members and frictionally retaining said two flexible members in releasable engagements.

2. The foil remover of claim 1, wherein said flexible members are configured to interlock with each other at their respective first ends.

3. The foil remover of claim 1, wherein said flexible members are retained solely by said chuck.

4. The foil remover of claim 1, wherein sliding motion of said flexible members with respect to said chuck in one direction causes said second ends to approach each other and sliding motion of said flexible members with respect to said chuck in an opposite direction causes said second ends to spread apart.

5. The foil remover of claim 1, wherein said flexible members are fabricated separately and joined at their respective first ends during assembly.

6. The foil remover of claim 1, wherein each of said flexible members includes an outwardly extending portion defining at least a portion of said second end.

7. The foil remover of claim 6 wherein each of said flexible members includes a body section and a tip section, said tip section defined by a higher coefficient of friction.

8. The foil remover of claim 1, wherein a portion of each of said second ends includes a material with a higher coefficient of friction than the material of the respective flexible member.

9. The foil remover of claim 8, wherein said material with a higher coefficient of friction forms the tip of the respective second end.

10. A system for removing foils overlying stacks of plates, said system comprising:

a carrier movable in a first direction;

two flat flexible members, each of said members having a first end and a second end, said two flexible members cooperatingly configured for said respective second ends to move laterally with respect to each other;

a chuck coupled to said carrier and movable in a second direction, said chuck slidably receiving said two flexible members and frictionally retaining said two flexible members in releasable engagements.

11. The system of claim 10, wherein said flexible members are retained solely by said chuck.

12. The system of claim 10, wherein sliding motion of said flexible members with respect to said chuck in one direction causes said second ends to approach each other and sliding motion of said flexible members with respect to said chuck in an opposite direction causes said second ends to spread apart.

13. The system of claim 10, wherein said flexible members are fabricated separately and joined at their respective first ends during assembly.

14. The system of claim 10, additionally comprising a disposal station for receiving said removed foil.

15. The system of claim 14, wherein said disposal station includes a pair of pinch rollers to remove foils from said carrier.

16. The system of claim 10, wherein a portion of each of said second ends includes a material with a higher coefficient of friction than the material of the respective flexible member.

17. The system of claim 16, wherein said material with a higher coefficient of friction forms the tip of the respective second end.

18. The system of claim 10, wherein said at least one chuck includes a plurality of chucks.

19. The system of claim 18, wherein said flexible members are configured to interlock with each other at their respective first ends.

20. The system of claim 18, wherein each of said flexible members includes an outwardly extending portion defining at least a portion of said second end.

21. The system of claim 20 wherein each of said flexible members includes a body section and a tip section, said tip section defined by a higher coefficient of friction.

22. A method for removing one or more foils overlying a stack of plates, comprising:

(a) providing a movable carriage, said carriage including at least one foil remover, each comprising;

two flat flexible members, each of said members having a first end and a second end, said two flexible members cooperatingly configured for said respective second ends to move laterally with respect to each other; and a chuck, slidably receiving said two flexible members and frictionally retaining said two flexible members in releasable engagements;

(b) moving said movable carriage to a pick up position over the stack;

(c) moving said chuck and said flexible member toward the stack until said flexible members contact the foils, then continuing said motion of said chuck, thereby causing said second ends of said two flexible members to approach each other and to grip the foils therebetween;

(d) moving said chuck, while said flexible members grip the foils, away from the stack of plates;

(e) moving said carriage away from said pick up position; and (f) causing said two flexible members to slide within said chuck so as to cause said second ends to spread apart and thereby to release the foils.

23. The method of claim 22, additionally comprising:

(g) providing a disposal station; and (h) following step (e), moving said carriage so that said chuck is over said disposal station.

24. The method of claim 22, wherein said flexible members are retained solely by said chuck.

25. The method of claim 22, wherein a portion of each of said second ends includes a material with a higher coefficient of friction than the material of the respective flexible member.

* * * * *